US008707591B2

(12) United States Patent
Moon et al.

(10) Patent No.: US 8,707,591 B2
(45) Date of Patent: Apr. 29, 2014

(54) METHOD FOR OPERATING MULTI-CLOTHES STYLER SYSTEM

(71) Applicant: LG Electronics Inc., Seoul (KR)

(72) Inventors: Taechul Moon, Seoul (KR); Kayeon Kim, Seoul (KR); Ayeong Lee, Seoul (KR); Sogkie Hong, Seoul (KR); Junghwan Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/647,976

(22) Filed: Oct. 9, 2012

(65) Prior Publication Data

US 2013/0086830 A1 Apr. 11, 2013

(30) Foreign Application Priority Data

Oct. 10, 2011 (KR) ..... 10-2011-0103139

(51) Int. Cl.
*D06F 58/12* (2006.01)
*A41D 27/22* (2006.01)
*D06F 57/00* (2006.01)

(52) U.S. Cl.
USPC ..... 38/14; 38/1 A; 223/85

(58) Field of Classification Search
USPC ..... 38/1 A, 2, 4, 1 C, 1 D, 14; 8/149.3; 68/5 C, 5 R; 34/164, 90, 209, 210, 401; 211/89.01, 105.1, 113, 123, 124; 312/114, 128, 198, 134, 273; 223/85; D32/60; 414/744.1
See application file for complete search history.

(56) References Cited

U.S. PATENT DOCUMENTS

| | | | | | |
|---|---|---|---|---|---|
| 1,602,315 | A * | 10/1926 | Wood | 34/164 |
| 3,114,919 | A * | 12/1963 | Kenreich | 8/147 |
| 3,739,496 | A * | 6/1973 | Buckley et al. | 34/210 |
| 3,872,587 | A * | 3/1975 | Wellinger | 30/43.92 |
| 4,682,424 | A * | 7/1987 | Irving | 34/621 |
| 4,930,113 | A * | 5/1990 | Sallas | 367/190 |
| 7,103,996 | B2 * | 9/2006 | Hapke | 38/14 |
| 7,137,211 | B2 * | 11/2006 | Johnson et al. | 34/381 |
| 8,151,495 | B2 * | 4/2012 | Kim et al. | 38/14 |
| 8,296,967 | B2 * | 10/2012 | Kim et al. | 34/164 |
| 8,503,700 | B2 * | 8/2013 | Fujise et al. | 381/162 |
| 8,523,264 | B2 * | 9/2013 | Kuroki et al. | 296/96.21 |
| 2005/0035076 | A1 * | 2/2005 | Schober et al. | 211/123 |
| 2005/0223502 | A1 * | 10/2005 | Kleker | 8/158 |
| 2006/0037209 | A1 | 2/2006 | Johnson et al. | |

FOREIGN PATENT DOCUMENTS

| | | |
|---|---|---|
| JP | 2006-130157 | 5/2006 |
| JP | 2006255302 | 9/2006 |
| JP | 2009250540 | 10/2009 |
| KR | 10-2012-0033034 A | 4/2012 |
| WO | WO 2010/082759 A2 | 7/2010 |
| WO | WO 2011/108860 A2 | 9/2011 |
| WO | WO 2011/108865 A2 | 9/2011 |

* cited by examiner

*Primary Examiner* — Ismael Izaguirre
(74) *Attorney, Agent, or Firm* — McKenna Long & Aldridge LLP

(57) ABSTRACT

The method for operating a multi-clothes styler system having a first styler and a second styler each with a hanger for applying vibration to clothes hung therefrom, includes an antiphase control step for controlling a vibration phase of a second hanger of the second styler to become an antiphase of the vibration phase of a first hanger of the first styler, if the first hanger of a first clothes styler and the second hanger of a second clothes styler are operated at the same time, and vibration frequencies of the first hanger and the second hanger are the same, whereby minimizing noise produced from the vibration of a plurality of hangers, and preventing the multi-clothes styler system from damaging due to intense variation to prevent a lifetime thereof from reducing.

13 Claims, 9 Drawing Sheets

METHOD FOR OPERATING MULTI-CLOTHES STYLER SYSTEM

CROSS REFERENCE TO RELATED APPLICATION

This application claims the benefit of the Patent Korean Application No. 10-2011-0103139, filed on Oct. 10, 2011, which is hereby incorporated by reference as if fully set forth herein.

BACKGROUND OF THE DISCLOSURE

1. Field of the Disclosure

The present invention relates to a method for operating a multi-clothes styler system for preventing vibration from amplifying when hangers in the multi-clothes styler system vibrate at a time.

2. Discussion of the Related Art

The clothes styler is an apparatus for treating clothes placed in a clothes space provided in a cabinet by supplying mist or hot air thereto. The treatment of clothes means a series of steps in which the mist or the hot air (Including mere air blow) is supplied to the clothes to remove smell, rumple, or moisture from the clothes for providing satisfaction to a user who puts on the clothes.

For an example, if the same clothes are put on more than once, the clothes may have the smell, the rumple or moisture remained thereon, to give unpleasant feeling to the user who intends to put on the clothes, again. Though the clothes may be washed for removing this, frequent washing of the clothes may shorten lifetime of the clothes, and increases cost required for maintenance and management of the clothes.

And, even if the clothes are washed and dried, there are cases when the rumple remains thereon. Such clothes can not be put readily, but requires the user to carry out cumbersome pressing.

In order to solve above problem, the clothes styler may be used for removing the smell, the rumple, or the moisture from the clothes. The clothes styler may spray steam to the clothes for removing the smell, the rumple, or the moisture from the clothes, and blows air (Including hot air) to the clothes for drying the clothes containing moisture due to the steam sprayed thus.

Though only with exposure of the clothes to wind or the hot air, an effect of removing the smell, the rumple, or the moisture may be provided, the mist may be supplied to the clothes for maximizing the effect.

If the steam is sprayed to the clothes placed in the clothes styler, fine water particles couple to smell particles remained deep in fabric tissue, and the water particle coupled to the smell particle thus is separated from the clothes and discharged to an outside of the clothes in a drying process, thereby removing the smell from the clothes.

And, if as one form of the mist to be supplied to the clothes in the clothes styler, if the steam is used, the steam provides an effect of moderating the rumple on the clothes. The cloths wet with the steam supplied thus may have the rumple moderated or removed in the drying process.

By such a process, the smell, the rumple, or the moisture can be removed from the clothes, enabling the clothes user to put on the clothes in a more pleasant state.

In the clothes styler, there are a drum type clothes styler having a drum rotated by a motor and a cabinet type clothes styler. If the clothes styler is of the cabinet type, the clothes styler may be in a mode in which a clothes space which may be opened or closed selectively by a door provided to one side of the cabinet and a machinery room having various mechanical units mounted therein are provided in the cabinet.

Particularly, in order to treat the clothes simply without washing, the cabinet type clothes styler may be used. In this case, a large number of pieces of the clothes can be placed in the clothes space in the cabinet in parallel by placing a piece of the clothes on a clothes hanger and hanging the clothes hanger from a hanger in the clothes space.

Particularly, as the hanger, a movable hanger may be used for applying vibration to the clothes to enhance an effect of smoothing out the rumples, and making the steam or the hot air supplied thus to infiltrate into the fabric, well.

Recently, due to an inadequate capacity of one clothes styler, a multi-clothes styler system makes an appearance, which has a plurality of clothes stylers to meet increased demand on a plurality of clothes stylers.

However, if the movable hangers in the multi-clothes styler system vibrate at a time, the vibration amplifies to increase noise, affecting a lifetime of the clothes styler, causing a problem of increased frequency of damage.

SUMMARY OF THE DISCLOSURE

Accordingly, the present invention is directed to a method for operating a multi-clothes styler system.

An object of the present invention is to provide a method for operating a multi-clothes styler system for preventing vibration from superimposing to amplify the vibration if a plurality of hangers in the multi-clothes styler system vibrate at a time.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for operating a multi-clothes styler system having a first styler and a second styler each with a hanger for applying vibration to clothes hung therefrom, includes an antiphase control step for controlling a vibration phase of a second hanger of the second styler to become an antiphase of the vibration phase of a first hanger of the first styler, if the first hanger of a first clothes styler and the second hanger of a second clothes styler are operated at the same time, and vibration frequencies of the first hanger and the second hanger are the same.

In this case, the antiphase control step may include the step of delaying operation of the second hanger until the vibration phase of the second hanger becomes the antiphase of the vibration phase of the first hanger.

In the meantime, the antiphase control step may include a frequency change step for changing a vibration frequency of the second hanger, and a frequency synchronizing step for making frequencies of the first hanger and the second hanger to coincide.

The frequency change step may be performed at a time point the vibration frequencies of the first hanger and the second hanger end at the same time.

In the frequency change step, the vibration frequency of the second hanger may be $(2n+1)/2$ of the vibration frequency of the first hanger, where the n denotes 0 or a natural number.

The frequency synchronizing step may be performed at a time point when the first hanger and the second hanger have opposite phases and the vibration frequencies of the first hanger and the second hanger end at the same time.

The method may further include an amplitude synchronizing step for making the vibration amplitude of the first hanger to coincide with the vibration amplitude of the second hanger.

The method may further include an inphase preventive step for controlling the second hanger such that the vibration phase of the second hanger is not to be an inphase of the vibration phase of the first hanger, if the vibration frequencies of the first hanger and the second hanger are not the same.

And, the inphase preventive step may include a frequency synchronizing step for changing at least one of the vibration frequencies of the first hanger and the second hanger to make the vibration frequencies of the first hanger and the second hanger to coincide.

The frequency synchronizing step may be performed at a time point the vibration frequencies of the first hanger and the second hanger end at the same time.

The method may further include a delay step for stopping the vibration of the second hanger for (2n+1)/2 frequencies if the phases of the first hanger and the second hanger are the same at a time point the frequency synchronizing step is performed, where the n denotes 0 or a natural number.

The method may further include an amplitude synchronizing step for making the vibration of the first hanger and the vibration of the second hanger to coincide.

The vibration frequency of each of the hangers may be measured with a hall sensor which senses movement of the hanger.

In another aspect of the present invention, a multi-clothes styler system includes a first clothes styler having a first hanger for applying vibration to clothes hung therefrom, a second clothes styler having a second hanger for applying vibration to the clothes hung therefrom, and a control unit for controlling a vibration phase of the second hanger to become an antiphase of the vibration phase of the first hanger, if the first hanger and the second hanger are operated at the same time, and vibration frequencies of the first hanger and the second hanger are the same.

The control unit may delay operation of the second hanger until the vibration phase of the second hanger becomes an antiphase of the vibration phase of the first hanger.

The control unit may control the vibration frequencies of the first hanger and the second hanger to be different from each other, by changing the vibration frequency of the second hanger, and may make the variation frequencies of the first hanger and the second hanger to coincide at a time point the phases of the first hanger and the second hanger are opposite to each other and the vibration frequencies end at the same time.

The control unit may change the vibration frequency of the second hanger to be (2n+1)/2 of the vibration frequency of the first hanger, where the n denotes 0 or a natural number.

The control unit may control to make the vibration frequency of the first hanger and the vibration frequency of the second hanger to coincide.

The control unit may change at least one of the vibration frequencies of the first hanger and the second hanger to make the vibration frequencies of the first hanger and the second hanger to coincide, if the vibration frequencies of the first hanger and the second hanger are not the same.

The control unit may make the vibration frequencies of the first hanger and the second hanger to coincide at a time point the vibration frequencies of first hanger and the second hanger end at the same time.

The control unit may delay the vibration of the second hanger for (2n+1)/2 frequencies if the phases of the first hanger and the second hanger are the same at a time point the vibration frequencies of the first hanger and the second hanger end at the same time, where the n denotes 0 or a natural number.

The system may further include a hall sensor for sensing movement of the first hanger and the second hanger.

Advantageous Effect of the Invention

The noise produced from a plurality of hangers in the multi-clothes styler system when the hangers vibrate at the same time can be minimized, and damage of the multi-clothes styler system caused by intense vibration can be prevented, thereby preventing a lifetime of the multi-clothes styler system from reducing.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

A method for controlling a drying cycle of a drying and washing machine in accordance with a preferred embodiment of the present invention and the drying and washing machine used in the method will be described, in detail. Names of elements defined in describing the present invention are given taking functions in the present invention into account, respectively.

Therefore, it is required that the names are not to be understood as meanings which limit technical elements of the present invention. And, the names of the elements may have other names in this field of art.

Figure 1:
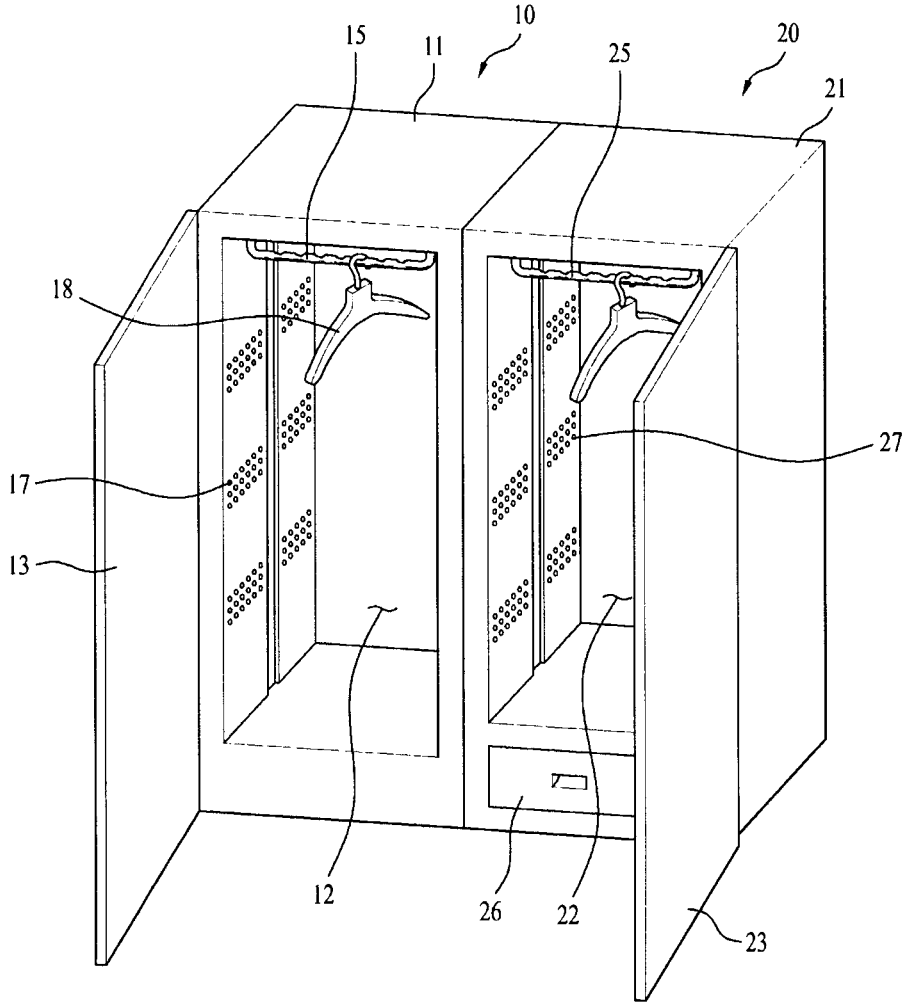
FIG. 1 illustrates a perspective view of a multi-clothes styler system.

FIG. 1 illustrates a perspective view of a multi-clothes styler system. The multi-clothes styler system is characterized in that a plurality of cabinet type clothes stylers 10 and 20 are connected in succession for increasing an amount of clothes to be treated. The multi-clothes styler system of the present invention includes a first clothes styler 10 and a second clothes styler 20.

The clothes styler 10 or 20 includes a cabinet 11 or 21 for forming an exterior appearance of the clothes styler, and a treating chamber 12 or 22 in the cabinet 11 or 21 for housing the clothes. And, the clothes styler 10 or 20 also includes a door 13 or 33 mounted to a front of the cabinet 11 or 21 for isolating the treating chamber 12 or 22 from an outside of the cabinet, or opening the treating chamber 12 or 22 to the outside of the treating chamber 12 or 22, and a hanger 15 or 25 mounted to one side of the treating chamber 12 or 22 for hanging the clothes therefrom. The clothes styler 10 or 20 of the present invention is characterized in that the clothes are not placed on a bottom, but hung from an upper side or a side thereof.

The treating chamber 12 or 22 is a space for applying hot air or steam to the clothes housed therein to change physical or chemical properties of the clothes. That is, the clothes may be dried by applying the hot air thereto, or the rumple on the clothes may be smoothed out by using the steam. Or, the clothes may have an aromatic agent sprayed thereto to make the clothes to give out a sweet smell, or antistatic agent sprayed thereto for preventing the clothes from being charged with static electricity. Thus, the treating chamber 12 or 22 is a space for treating the clothes by a variety of methods.

In general, though the hanger 15 or 25 may have, but not limited to, a rod shape for hanging the clothes hanger 18 or 28 therefrom. The hanger 15 or 25 of the present invention has vibration applied thereto for enhancing a clothes treating effect. A driving unit positioned on one side of the treating chamber 12 or 22 converts rotation power of a motor into a vibratory movement in one or two axes directions by using a pulley or the like. The vibratory movement of the hanger 15 or 25 enhances an effect of smoothing out the rumples on the clothes and helps the steam and the hot air infiltrate into the clothes, better.

Figure 2:
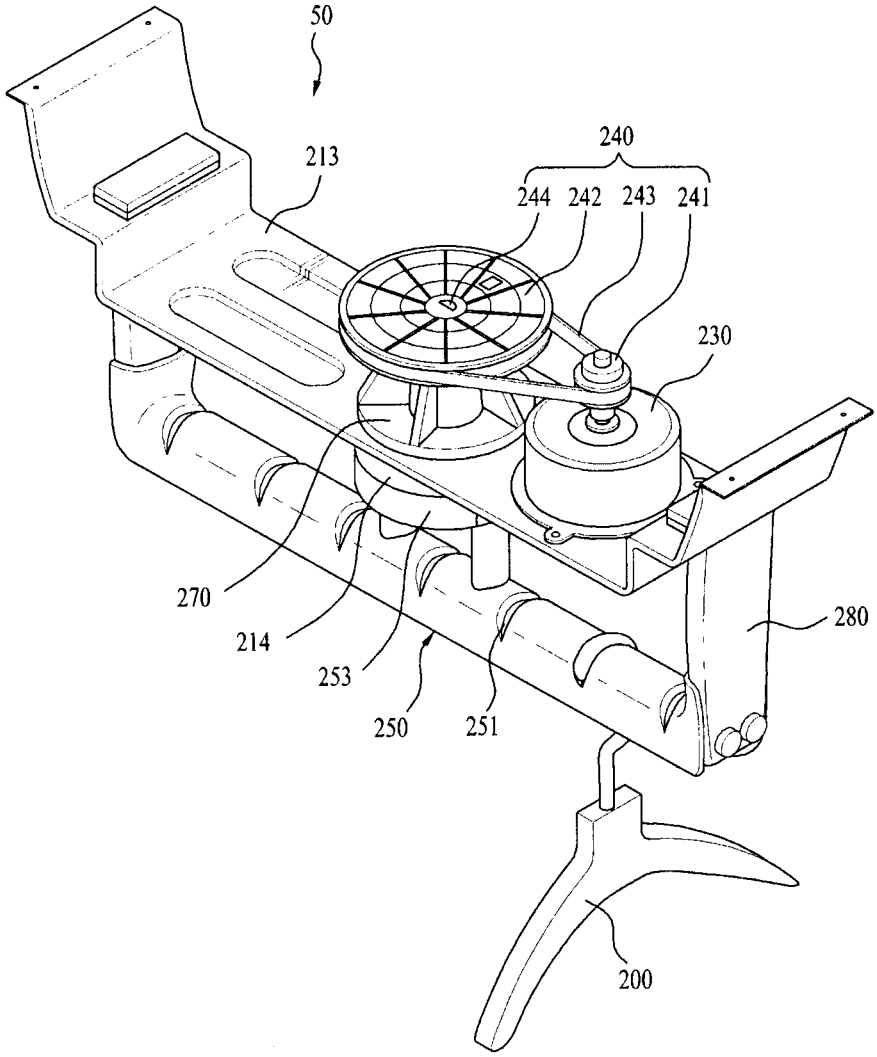
FIG. 2 illustrates a perspective view of a movable hanger in a multi-clothes styler system in accordance with a preferred embodiment of the present invention.
Figure 3:
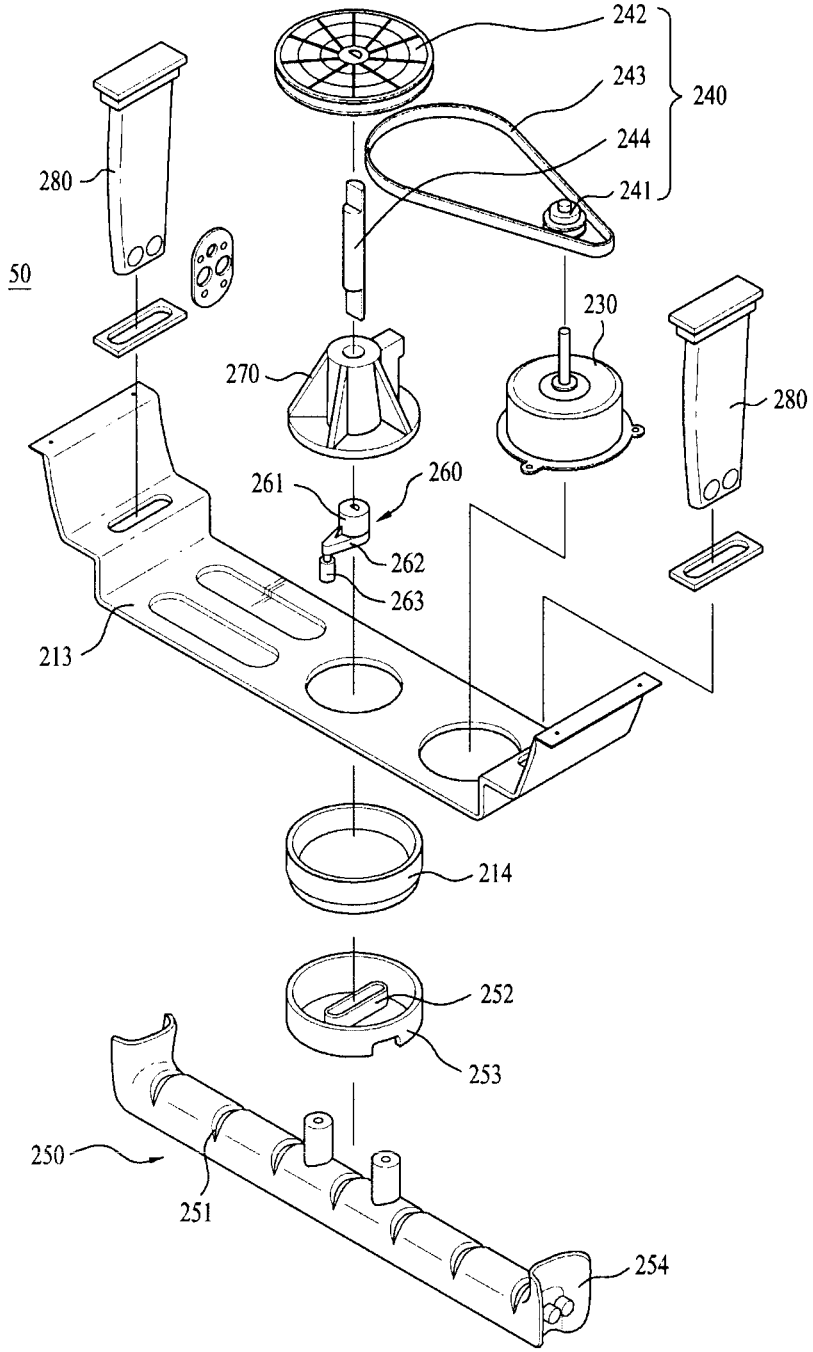
FIG. 3 illustrates an exploded perspective view of a part of a multi-clothes styler system in accordance with a preferred embodiment of the present invention.

A structure of the hanger 15 or 25 the vibration can be applied thereto will be described, in more detail. FIGS. 2 and 3 illustrate movable hangers 50 the vibration can be applied thereto respectively, which are vibratory hangers 50 applicable to both of the first hanger 15 and the second hanger 25.

FIG. 2 illustrates a perspective view of the movable hanger 50 in a multi-clothes styler system in accordance with a preferred embodiment of the present invention, and FIG. 3 illustrates an exploded perspective view of the movable hanger 50 of a multi-clothes styler system in accordance with a preferred embodiment of the present invention.

Referring to FIGS. 2 and 3, the movable hanger 50 includes a hanger bar 250 for supporting a clothes hanger 200 having the clothes hung therefrom, and a supporter 280 for supporting both ends of the hanger bar 250. The hanger bar 250 has a plurality of clothes hanger grooves 251 provided therein for positioning the clothes hanger 200 when the clothes hanger 200 is placed thereon. The supporter 280 is connected to, and supported by, a movable hanger frame 213 provided to an upper side of an inside of ceiling of the cabinet 11 or 21 invisible from an outside of the cabinet 11 or 21. The hanger bar 250 has both ends provided with supporter ribs 254 to surround, and to be connected to, the supporter 280, respectively.

Therefore, since the clothes styler of the present invention has the clothes placed therein hung from the clothes hanger, the clothes styler has effects much better than the related art clothes styler, not only in refreshing, but also in drying efficiency of the clothes.

In the meantime, the movable hanger 50 includes a motor 230, a power converter 260 for converting rotating movement from the motor 230 to a horizontal linear movement of the hanger bar 250, and a power transmitter 240 for transmission of the power from the motor 230 to the power converter 260.

The power transmitter 240 may include a driving pulley 241 provided to the motor 230, a driven pulley 242 connected to the driving pulley 241 with a belt 243, and a rotating shaft 244 coupled to a center of the driven pulley 242. The rotating shaft 244 is rotatably mounted in a bearing housing 270 provided to the movable hanger frame 213.

It is preferable that the hanger bar 250 further includes a slot 252 perpendicular to a length direction of the hanger bar 250. In detail, the hanger bar 250 has a slot housing 254 over the hanger bar 250, with the slot 252 provided in the slot housing 253 at a center thereof, substantially. And, the power converter 260 may include a slot pin 263 placed in the slot 252, a shaft coupler 261 coupled to the rotating shaft 244, and a rotatable arm 262 connected between the slot pin 263 and the shaft coupler 261. The power converter 260 is covered with a cover 214 to make the power converter 260 invisible from an outside of the movable hanger 50 provided between the movable hanger frame 213 and the slot housing 253.

In above configuration, if the motor 230 rotates, the driven pulley 242 rotates to rotates the rotating shaft 244 coupled to the driven pulley 242 too, such that the slot pin 263 makes a circular motion with a predetermined diameter.

In the meantime, the slot 252 is provided to the hanger bar 250 perpendicular to a length direction of the hanger bar 250, with a length thereof longer than a rotating locus of the slot pin 263. Therefore, even if the slot pin 263 makes circular motion, the slot 252 makes a horizontal linear motion. According to this, the hanger bar 250 coupled to the slot 250 makes the horizontal linear motion, too.

In the meantime, a machinery room 26 is provided to one side of the treating chamber 22 to have an air supply unit 40 or a mist producing unit 30 for supplying the hot air or the steam to an inside of the treating chamber 12 or 22. Though FIG. 1 illustrates the machinery room 26 provided only to the second clothes styler 20, but the embodiment does not limit this, and the machinery room 26 may be provided only to the first clothes styler 10 or both of the clothes stylers 10 and 20. If the machinery room 26 is provided only to one side clothes styler 20, a duct or the like is connected from the one side styler 20 to the other side styler for supplying the steam or the hot air to the other side clothes styler through the duct.

Preferably, the machinery room 26 is positioned under the treating chamber 22, and has the air supply unit 40 and the mist producing unit 30 therein. The machinery room 26 is positioned under the treating chamber 22 because it is preferable that the treating room 22 is positioned under the machinery room 26 to supply the hot air and the steam by using a nature of rising of the hot air and the steam being supplied to the treating chamber 22.

Figure 4:
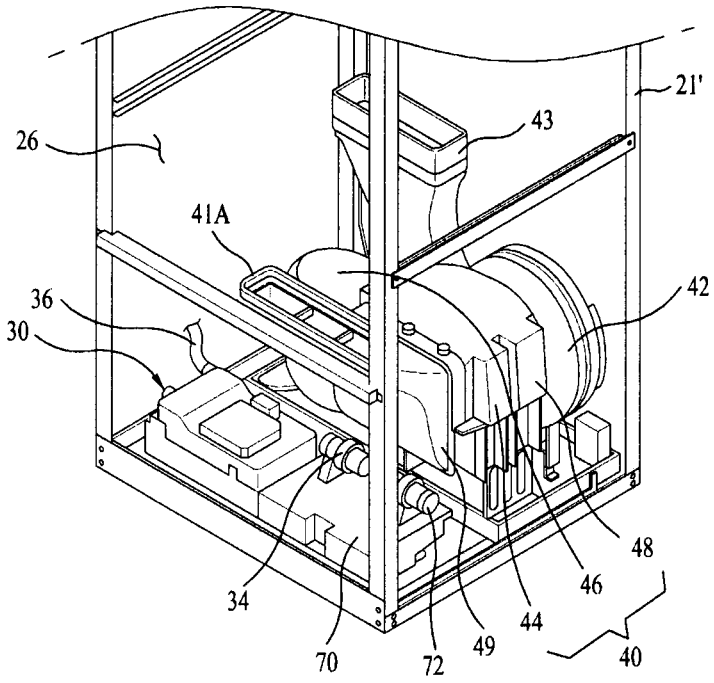
FIG. 4 illustrates a perspective view of an inside of a machinery room in a multi-clothes styler system in accordance with a preferred embodiment of the present invention, schematically.

FIG. 4 illustrates a perspective view of an inside of the machinery room, schematically. In order to show the inside of the machinery room 26, FIG. 4 illustrates a frame 21' of the cabinet 21 only, for convenience of view. And, for convenience of description, FIG. 4 illustrates major elements, including the air supply unit 40 and the mist producing unit 30, but not pipelines which connect the major elements.

Referring to FIG. 4, in the machinery room 26, there is the air supply unit 40 for supplying air or the hot air to the treating chamber 12 or 22.

A heat pump 42 which is the air supply unit of the present invention has an evaporator 44, a compressor 46, a condenser 48, and an expansion valve (Not shown) for circulating refrigerant to dehumidify and heat the air.

That is, as the refrigerant vaporizes at the evaporator 44, the refrigerant absorbs latent heat from surrounding air to cool down the air to condense moisture in the air, thereby removing the moisture from the air. And, if the refrigerant from the compressor 46 is introduced to, and condensed at, the condenser 48, the refrigerant discharges the latent heat to surrounding air to heat the surrounding air. According to this, since the evaporator 44 and the condenser 48 function as heat exchangers, the air introduced to the machinery room 26 has moisture thereof removed, or is heated, and supplied to the treating chamber 12 or 22.

Though the air heated by the heat pump 42 may have a temperature more or less lower than the air heated by a related art electric heater, the heat pump 42 can remove the moisture from the air without using a dehumidifier, additionally. Therefore, the air supplied to the treating chamber 12 or 22 by the heat pump 42 is 'low temperature air' relatively (In this case, the 'low temperature' means, not an absolutely low temperature, but a relatively low temperature compared to a related art heated air, though the air is heated air).

The clothes styler in accordance with a preferred embodiment of the present invention can prevent the clothes from distorting or damaging by a high temperature if clothes refreshing or drying is performed by supplying the low temperature air. In conclusion, though the air supplied by the heat pump 42 has a temperature lower than the hot air of the related art clothes styler, since the clothes styler in accordance with a preferred embodiment of the present invention supplies the air having the moisture removed therefrom without the dehumidifier, easy drying or refreshing of the clothes is possible.

In detail, the machinery room 26 has an air inlet 41A (See FIG. 4) formed in an upper side of a front thereof for introducing the air from the treating chamber 12 or 22 thereto, and an introduction duct 29 connecting the air inlet 41A to the evaporator 44, the condenser 48, and the fan 42 forms a flow passage for flowing the air. The air introduced to the machinery room 26 through the introduction duct 49 and the air inlet 41A has the moisture removed therefrom and heated as the air passes through the heat pump 42, and is supplied to the treating chamber 12 or 22 through a discharge duct 43 and an air outlet 418 by the fan 42, again.

Though not shown, preferably, the air inlet 41A may have a filter provided thereto. By providing the filter to the air inlet, various foreign matters may be filtered from the air introduced to the machinery room 26 from the treating chamber 12 or 22, to enable to supply only fresh air to the treating chamber 12 or 22.

In the meantime, the machinery room 26 has the mist producing unit 30 provided thereto for supplying the moisture of mist, the mist or the steam (Hereafter, 'steam') to the treating chamber 12 or 22, selectively.

The mist producing unit 30 has a heater (Not shown) provided therein for heating the water to produce the steam to be supplied to the treating chamber 12 or 22. As a water supply source for supplying the water to the mist producing unit 30, an external water faucet may be used or a water supply tank (Not shown) provided to one side of the machinery room 26 may be used.

And, the steam produced from the mist producing unit 30 is supplied to the treating chamber 12 or 22 through a steam hose 36 and a steam nozzle 40 (See FIGS. 1 and 2). In this case, in order to prevent a temperature of the steam from dropping or the steam from condensing during the steam flows along the steam hose 36, it is preferable that the steam hose 36 is short. Accordingly, if the machinery room 26 is positioned under the treating chamber 12 or 22, it is preferable that the steam nozzle 40 supplies the steam through an upper side of the machinery room 26, i.e., an underside of the treating chamber 12 or 22.

And, the machinery room 26 may have a circulating fan (Not shown) provided to a rear thereof. The circulating fan supplies the air to the machinery room 26 from an outside of the machinery room 26 for preventing a temperature of an inside of the machinery room 26 from rising excessively due to operation of the heat pump 42 and the mist producing unit 30.

Figure 5:
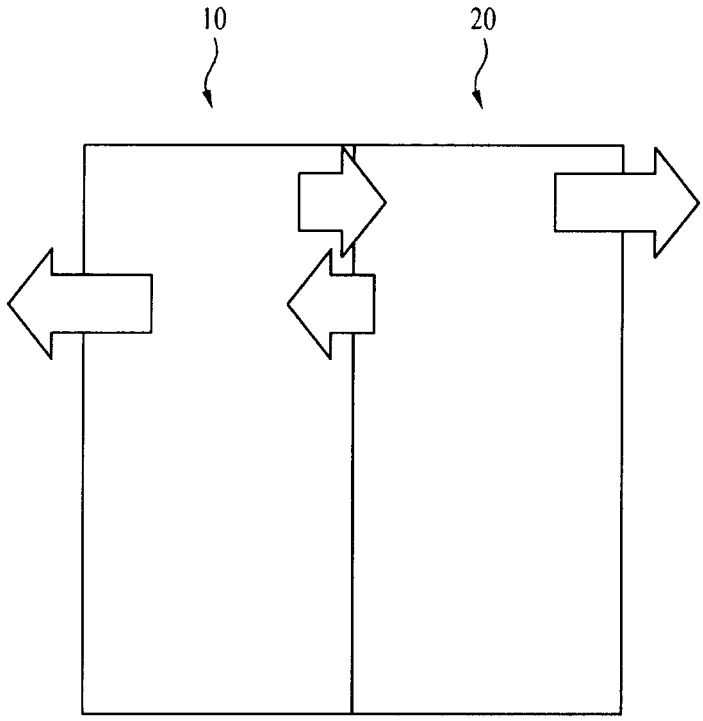
FIG. 5 illustrates a schematically perspective view showing vibration behavior of a multi-clothes styler system in accordance with a preferred embodiment of the present invention.

Though the multi-clothes styler system treats the clothes in spaces independent from one another, if the hanger 15 or 25 vibrates at a time, the vibration is liable to amplify as shown in FIG. 5.

Figure 6:
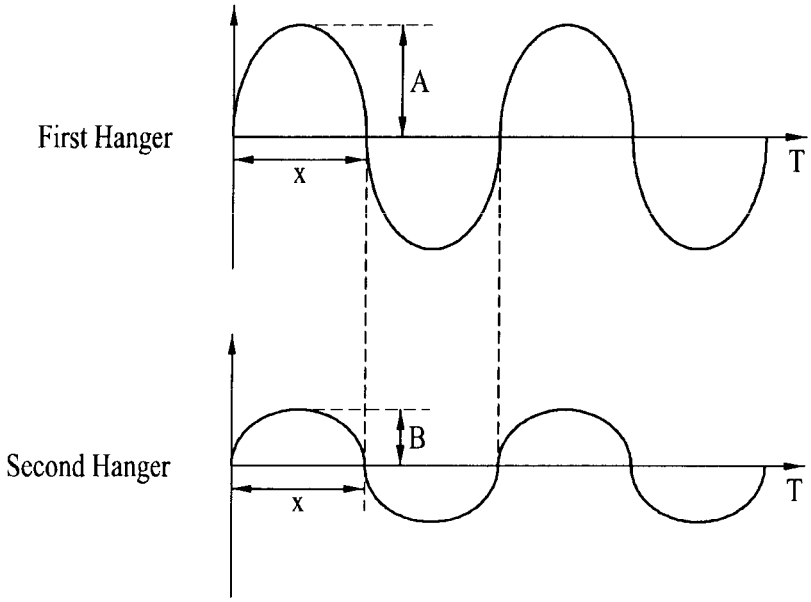
FIGS. 6 and 7 illustrate graphs showing vibration of a multi-clothes styler system in accordance with a preferred embodiment of the present invention, respectively.
Figure 7:
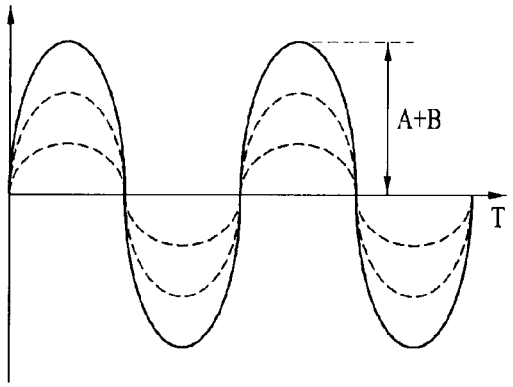

FIG. 6 illustrates graphs showing vibration behavior of a first clothes styler 10 and vibration behavior of a second clothe styler 20, each of which vibrates with a predetermined amplitude A and B. If phases of the vibration are the same, to amplify the vibration as shown in FIG. 7, noise becomes large to apply a heavy impact to the clothes styler resulting in damage to the clothes styler.

The present invention relates to a method for operating a multi-clothes styler system for preventing the vibration from amplifying in a case the first clothes styler 10 and the second clothes styler 20 are operated at the same time.

The multi-clothes styler system includes a control unit for controlling vibration of the first hanger and the second hanger. In the method for operating a multi-clothes styler system to be described below, control of vibration frequencies and amplitude of the first hanger and the second hanger is performed by the control unit.

Figure 8:
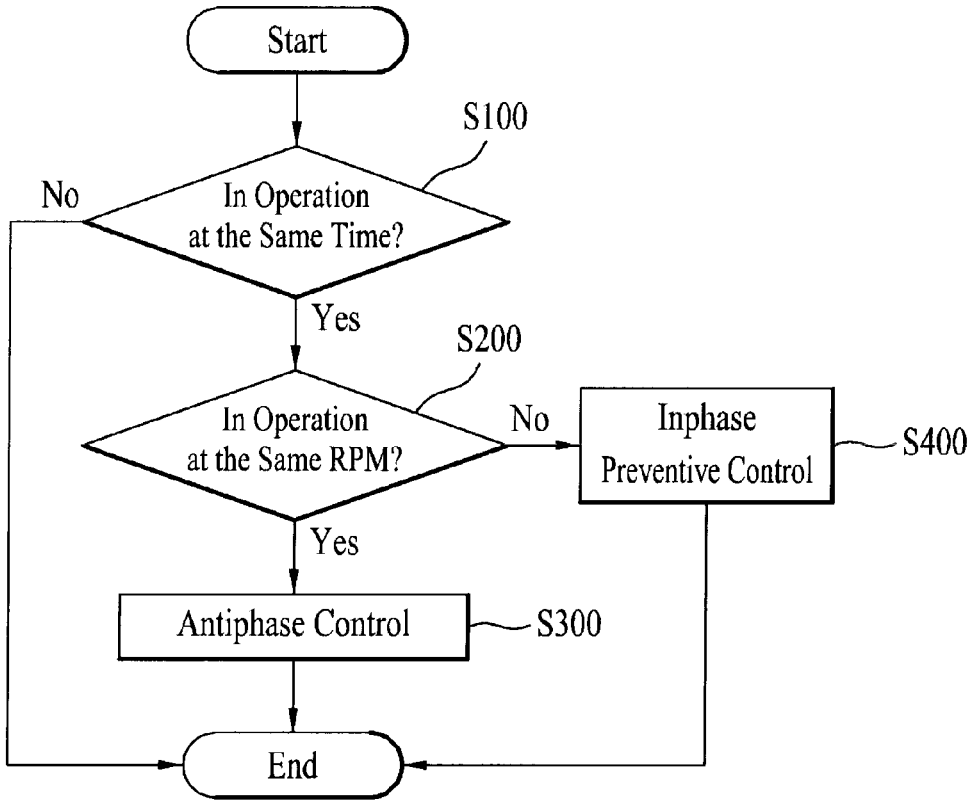
FIG. 8 illustrates a flow chart showing the steps of a method for operating a multi-clothes styler system in accordance with a first preferred embodiment of the present invention.

FIG. 8 illustrates a flow chart showing the steps of a method for operating a multi-clothes styler system in accordance with a first preferred embodiment of the present invention.

At first, it is determined whether the first hanger 15 of the first clothes styler 10, and the second hanger 25 of the second clothes styler 20 are in operation or not at the same time (S100). If yes, it is determined whether vibration frequencies of the hangers 15 and 25 are the same or not (S200). The vibration frequency relates to vibration frequency and cycle of the motor 230 which operates the hanger, and if the vibration frequencies are the same, periods of vibration cycles are the same which are liable to amplify the vibration. The hangers which vibrate at the same vibration frequency have the same cycle period and the same vibration frequency of the motor. The cycles of the hangers 15 and 25 shown in FIGS. 6 and 7 have the same cycle periods of 2x and the same vibration frequencies, respectively.

A case in which phases of the vibration of the first hanger 15 of the first clothes styler 10 and the vibration of the second hanger 25 of the second clothes styler 20 are the same to have the same direction of the vibration as shown in FIGS. 6 and 7, to add the two vibrations to increase amplitude thereof is called as an inphase, and opposite to this, another case in which, though the cycles are the same, the directions of the vibrations are opposite, is called as an antiphase. In the case of the inphase, an extent of amplification of the vibration becomes higher to cause a problem in that noise and impact applied to the clothes stylers 10 and 20 is intense. Opposite to this, in the case of the antiphase, since the vibrations offsets each other to make the amplitude smaller, the noise may be reduced smaller than one hanger vibrates as the vibration offsets.

Therefore, if the vibration frequencies of the first hanger 15 and the second hanger 25 are the same, an antiphase control is performed (S300), to make the vibration frequency of the second hanger 25 to become an antiphase of the vibration frequency of the first hanger 15.

Figure 9:
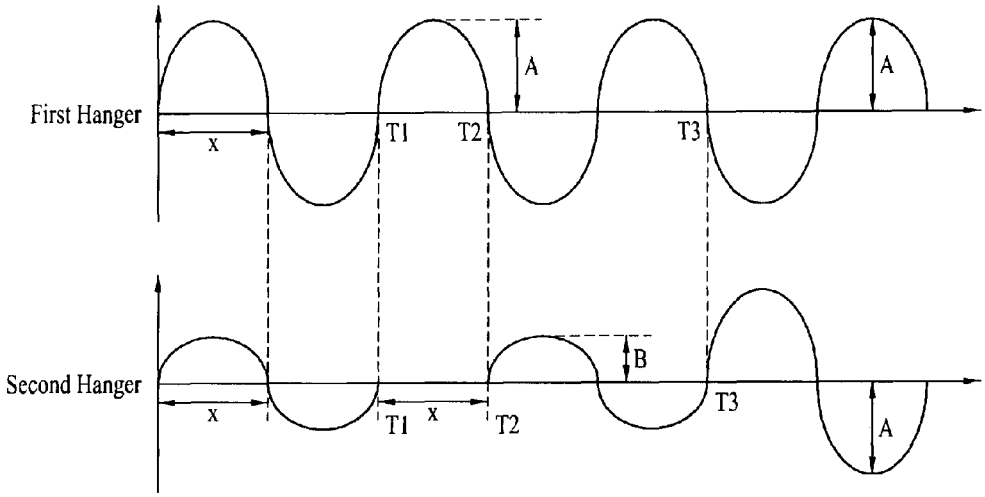
FIG. 9 illustrates a graph showing vibration of a multi-clothes styler system caused by a method for operating a multi-clothes styler system in accordance with a first preferred embodiment of the present invention.
Figure 10:
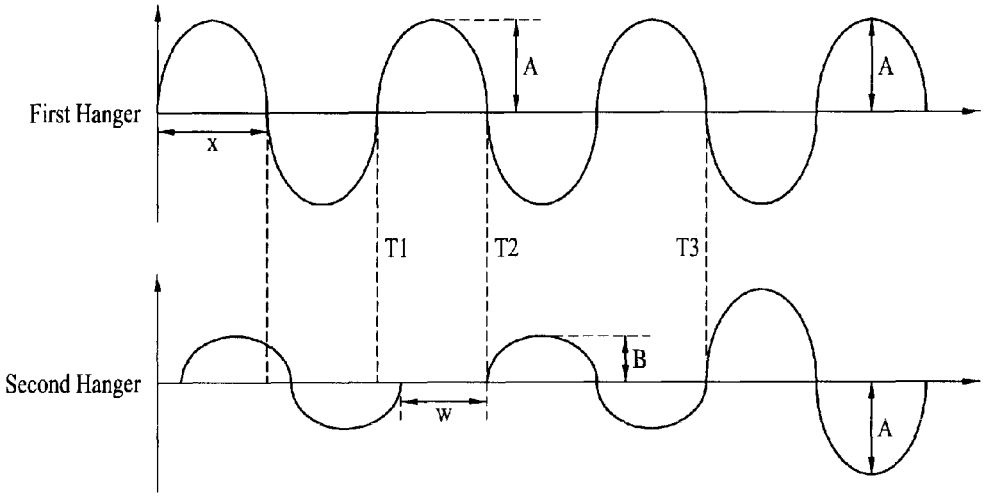
FIG. 10 illustrates a graph showing vibration of a multi-clothes styler system caused by a method for operating a multi-clothes styler system in accordance with a first preferred embodiment of the present invention.
Figure 11:
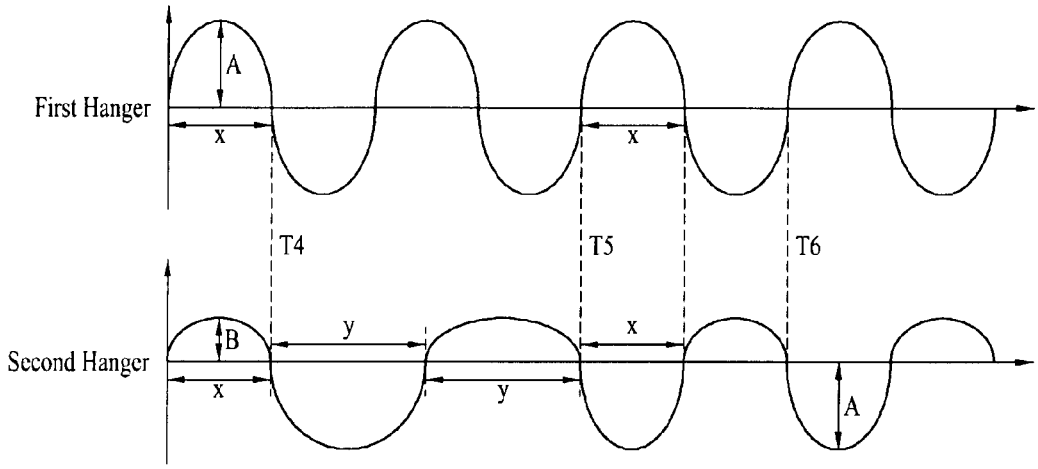
FIG. 11 illustrates a graph showing vibration of a multi-clothes styler system caused by a method for operating a multi-clothes styler system in accordance with a second preferred embodiment of the present invention.

The antiphase control is possible by a variety of methods. FIGS. 9 to 11 illustrate methods for controlling a multi-clothes styler system if the vibration frequencies are the same, i.e., the cycles are the same, respectively.

Referring to FIGS. 9 and 11, even if the vibrations of the first hanger 15 and the second hanger 25 are inphase initially, the vibrations are controlled to be an antiphase in a later half (After T2 of FIG. 9 or T5). Especially, if the vibrations are controlled to make the amplitudes of the first hanger 15 and the second hanger 25 to be the same (After T3), entire vibrations are offset, completely.

In more detail, referring to FIG. 9, by delaying the operation of the second hanger 25 until the vibration phase of the second hanger 25 becomes an antiphase of the vibration phase of the first hanger 15, an antiphase can be made. That is, after stopping the second hanger 25 for a certain time period, the vibration of the second hanger 25 may be started at a time point the phase of the second hanger 25 is opposite to the phase of the first hanger 15.

For an example, referring to FIG. 9, if the vibrations of the first hanger 15 and the second hanger 25 are inphase initially, the antiphase can be made by delaying half cycle x. As shown in FIG. 10, if the phases are not the inphase, but vary slightly with a difference of a time delay of w, operation of the second hanger 25 is delayed until the antiphase is made.

Referring to FIG. 11, in another method of antiphase control, operation of the second hanger 25 is controlled such that the vibration frequency of the second hanger 25 is changed temporarily, to make the vibration phase of the second hanger 25 to be an antiphase with the vibration phase of the first hanger 15. The antiphase control may include a frequency change step in which at least one of the vibration frequencies of the first hanger 15 and the second hanger 25 is changed and a frequency synchronizing step in which frequencies of the first hanger 15 and the second hanger 25 are made to coincide. Hereafter, for convenience of description, though a change of the frequency of the second hanger 25 is described as an example, it is apparent that frequencies both of the two hangers may be changed.

If the frequency is made low, a period of the cycle becomes long, to increase the period of the cycle from 2x to 2y as shown in FIG. 11. After certain cycles are repeated, if the vibration frequencies are made the same from a moment (T2 or T3) the directions of the vibrations of the first hanger 15 and the second hanger 25 are opposite, the first hanger 15 and the second hanger 25 vibrate in the antiphase state, to make an entire vibration minimum.

In more detail, referring to FIG. 11, it is preferable that the time point the frequency change step is performed is a time point (A starting point in FIG. 11) when the vibration frequencies of the first hanger 15 and the second hanger 25 are end at the same time. Along with this, if the phases of the first hanger 15 and the second hanger 25 are opposite to each other at a time point the frequency change step is performed, the vibration frequency of the first hanger 15 may be changed to (2n+1)/2 of the vibration frequency of the second hanger. And, if the phases of the first hanger 15 and the second hanger 25 are the same at a time point the frequency change step is performed, the vibration frequency of the second hanger 25 may be changed to an n of the vibration frequency of the first hanger 15. The n denotes 0 or a natural number.

After the frequency change step, the frequency synchronizing step is performed. It is preferable that the frequency synchronizing step is performed at a time point T5 when the phases of the first hanger 15 and the second hanger 25 are opposite to each other and the vibration frequencies end at the same time. If the frequency change step is performed, the vibration frequencies of the first hanger 15 and the second hanger 25 end at the same time point T5 after a certain time period is passed. Of the time points when the vibration frequencies of the first hanger 15 and the second hanger 25 end at the same time point thus, the frequency synchronizing step is performed at the time point the phases of the first hanger 15 and the second hanger 25 are opposite to each other. Therefore, the first hanger 15 and the second hanger 25 may be controlled to be in the antiphase. This method is also applicable even if the first hanger 15 and the second hanger 25 are not in the antiphase, initially. In the meantime, if the amplitudes of the first hanger 15 and the second hanger 25 are different, an amplitude synchronizing step may further be performed, to make the amplitudes of the two hangers to coincide. The amplitude synchronizing step may be performed before or after the antiphase control step, preferably after the antiphase control step.

If the vibration frequencies of the first hanger 15 and the second hanger 25 are not the same, an inphase preventive step (S400) is performed, which is characterized in that the second hanger 25 is controlled for preventing the vibration phase of the second hanger 25 from being an inphase of the vibration phase of the first hanger 15.

The inphase preventive step (S400) may include the frequency synchronizing step in which at least one of vibration frequencies of the first hanger 15 and the second hanger 25 is changed to make the vibration frequencies of the first hanger 15 and the second hanger 25 to coincide. It is preferable that the frequency synchronizing step is performed at a time point the vibration frequencies of the first hanger 15 and the second hanger 25 are finished at the same time.

Figure 12:
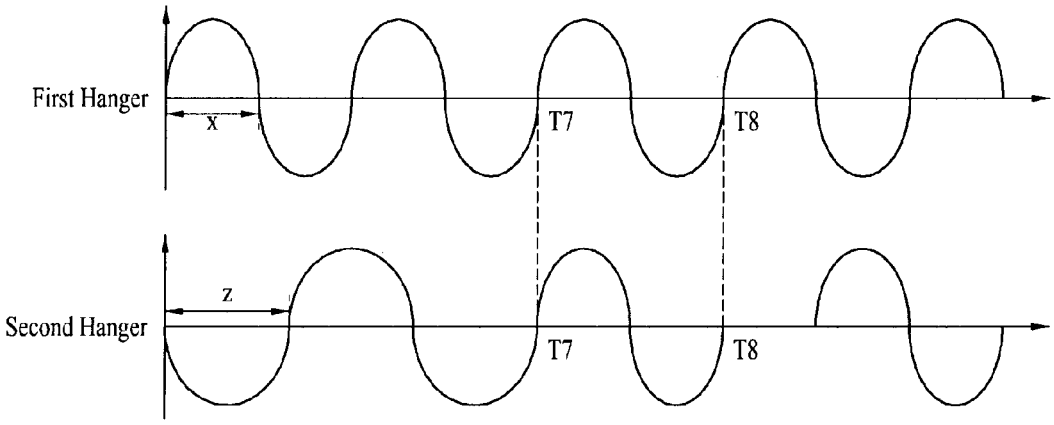
FIG. 12 illustrates a graph showing vibration of a multi-clothes styler system caused by a method for operating a multi-clothes styler system in accordance with a third preferred embodiment of the present invention.

FIG. 12 illustrates a graph showing the inphase preventive step in a method for operating a multi-clothes styler system in accordance with a third preferred embodiment of the present invention, wherein the inphase preventive step (S400) is performed since the vibration frequencies of the first hanger 15 and the second hanger 25 are not the same, initially.

In accordance with a preferred embodiment of the present invention, the inphase preventive step (S400) may includes the frequency synchronizing step and a delay step in which the vibration of the second hanger is stopped for a certain time period.

It is preferable that the frequency synchronizing step is performed at a time point the vibration frequencies of the first hanger 15 and the second hanger 25 end at the same time.

Referring to FIG. 12, at the time point T7 the frequency synchronizing step is performed, if the phases of the first hanger 15 and the second hanger 25 are the same, it is preferable that the vibration of the second hanger stops for (2n+1)/2 cycles in the delay step, where the n denotes 0 or a natural number. In the meantime, if the phases of the first hanger 15 and the second hanger 25 are opposite at the time point the frequency synchronizing step is performed, the delay step may be omitted.

Referring to FIG. 12, in the inphase control step which is a step for obtaining a result the same with the antiphase control step ultimately, at first, the vibration frequency of the second hanger 25 is changed, to coincide with the vibration frequency of the first hanger 15 (A T7 to T8 section), and operation of the second hanger 25 is delayed to make the vibration frequency of the second hanger 25 becomes an antiphase of the vibration frequency of the first hanger 15 (After T8). As shown in FIG. 12, the vibration of the second hanger 25 is delayed by half cycle, to control the phase of the second hanger 25 to be an antiphase of the phase of the first hanger 15, the vibrations are offset.

Figure 13:
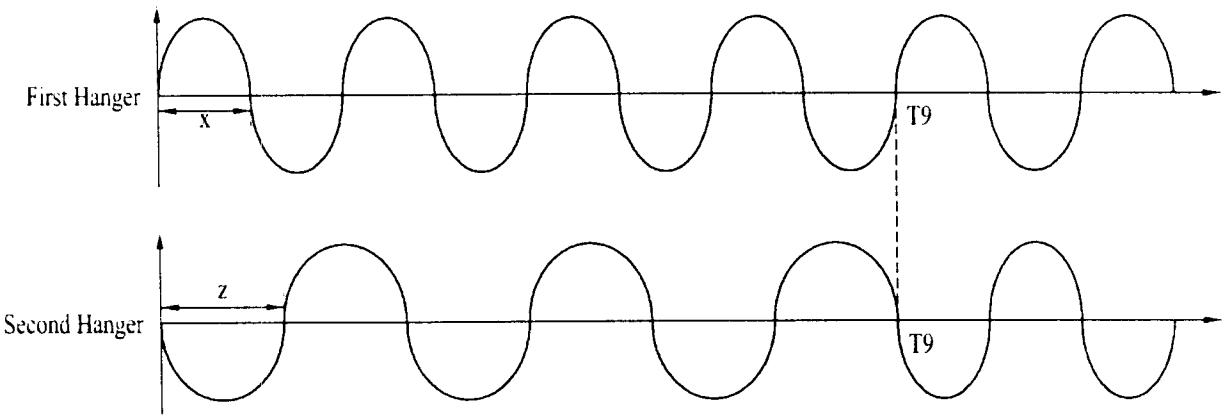
FIG. 13 illustrates a graph showing vibration of a multi-clothes styler system caused by a method for operating a multi-clothes styler system in accordance with a fourth preferred embodiment of the present invention.

In the meantime, referring to FIG. 13, at the time point the frequency synchronizing step is performed T9, the phases of the first hanger 15 and the second hanger 25 are opposite. In this case, the delay step may be omitted. That is, when a direction of the vibration of the second hanger 25 is opposite to the direction of the vibration of the first hanger 15 T9, the vibration frequencies of the first hanger 15 and the second hanger 25 are made the same, to control the phase of the first hanger is antiphase of the phase of the second hanger.

The inphase preventive step (S400) may also include the amplitude synchronizing step for controlling the second hanger 25 to control the amplitude of the second hanger to be the same with the amplitude of the first hanger 15 if the amplitude of the first hanger 15 is different from the amplitude of the second hanger 25, for enhancing a vibration offsetting effect.

The method for operating a multi-clothes styler system of the present invention can minimize noise produced when the hangers vibrate and can prevent a lifetime of the multi-clothes styler system from reducing due to intensive vibration.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for operating a multi-clothes styler system having a first styler and a second styler each with a hanger for applying vibration to clothes hung therefrom, comprising:

an antiphase control step for controlling a vibration phase of a second hanger of the second styler to become an antiphase of the vibration phase of a first hanger of the first styler, if the first hanger of a first clothes styler and the second hanger of a second clothes styler are operated at the same time, and vibration frequencies of the first hanger and the second hanger are the same.

2. The method as claimed in claim 1, wherein the antiphase control step includes a step of delaying operation of the second hanger until the vibration phase of the second hanger becomes the antiphase of the vibration phase of the first hanger.

3. The method as claimed in claim 1, wherein the antiphase control step includes;

a frequency change step for changing a vibration frequency of the second hanger, and a frequency synchronizing step for making frequencies of the first hanger and the second hanger to coincide.

4. The method as claimed in claim 3, wherein the frequency change step is performed at a time point the vibration frequencies of the first hanger and the second hanger end at the same time.

5. The method as claimed in claim 4, wherein, in the frequency change step, the vibration frequency of the second hanger is (2n+1)/2 of the vibration frequency of the first hanger, where the n denotes 0 or a natural number.

6. The method as claimed in claim 3, wherein the frequency synchronizing step is performed at a time point when the first hanger and the second hanger have opposite phases and the vibration frequencies of the first hanger and the second hanger end at the same time.

7. The method as claimed in claim 1, further comprising an amplitude synchronizing step for making the vibration amplitude of the first hanger to coincide with the vibration amplitude of the second hanger.

8. The method as claimed in claim 1, further comprising an inphase preventive step for controlling the second hanger such that the vibration phase of the second hanger is not to be an inphase of the vibration phase of the first hanger, if the vibration frequencies of the first hanger and the second hanger are not the same.

9. The method as claimed in claim 8, wherein the inphase preventive step includes a frequency synchronizing step for changing at least one of the vibration frequencies of the first hanger and the second hanger to make the vibration frequencies of the first hanger and the second hanger to coincide.

10. The method as claimed in claim 9, wherein the frequency synchronizing step is performed at a time point the vibration frequencies of the first hanger and the second hanger end at the same time.

11. The method as claimed in claim 10, further comprising a delay step for stopping the vibration of the second hanger for (2n+1)/2 frequencies if the phases of the first hanger and the second hanger are the same at a time point the frequency synchronizing step is performed, where the n denotes 0 or a natural number.

12. The method as claimed in claim 8, further comprising an amplitude synchronizing step for making the vibration of the first hanger and the vibration of the second hanger to coincide.

13. The method as claimed in claim 1, wherein the vibration frequency of each of the hangers is measured with a hall sensor which senses movement of the hanger.

* * * * *